United States Patent [19]

Peters et al.

[11] 4,159,905

[45] Jul. 3, 1979

[54] METHOD OF MANUFACTURING GREEN HOT BRIQUETTES FROM FINE COAL FOR USE IN SHAFT FURNACES

[75] Inventors: Werner Peters, Wattenscheid; Josef Langhoff, Dinslaken; Siegfried Henkel, Blankenstein; Klaus D. Haverkamp, Gelsenkirchen, all of Fed. Rep. of Germany

[73] Assignees: Bergwerksverband GmbH; Rheinstahl Huttenwerke AG, both of Fed. Rep. of Germany

[21] Appl. No.: 543,888

[22] Filed: Jan. 24, 1975

Related U.S. Application Data

[63] Continuation of Ser. No. 96,258, Dec. 8, 1970, abandoned.

[51] Int. Cl.[2] ..... C21B 5/00

[52] U.S. Cl. ..... 75/42; 201/22

[58] Field of Search ..... 44/10 C, 10 H, 10 G, 44/10 J, 10 K; 201/5, 6, 21, 22, 24, 44; 75/42

[56] References Cited

U.S. PATENT DOCUMENTS

| | | | |
|---|---|---|---|
| 3,073,751 | 1/1963 | Gorin | 202/26 |
| 3,117,918 | 7/1964 | Batchelor | 202/26 |
| 3,401,089 | 9/1968 | Friedrich | 201/6 |
| 3,475,278 | 10/1969 | Peters | 201/6 |
| 3,841,849 | 10/1974 | Beckmann | 75/42 |

*Primary Examiner*—Hiram H. Bernstein
*Attorney, Agent, or Firm*—McGlew and Tuttle

[57] ABSTRACT

A method of manufacturing a briquetted coke from fine coal comprises carbonizing the coal at a temperature of from around 600° to 900° C., mixing the carbonized coal with approximately 10 to 80% and preferably from 20 to 40% of fine coal well caking coal, and thereafter hot briquetting the mixture at temperatures of from around 300° to 500° C. A fuel for shaft furnaces preferably includes the use of the hot briquettes as the only solid fuel in the shaft furnace, and it is particularly applicable for blast furnaces.

3 Claims, No Drawings

METHOD OF MANUFACTURING GREEN HOT BRIQUETTES FROM FINE COAL FOR USE IN SHAFT FURNACES

This is a continuation of application Ser. No. 96,258 filed Dec. 8, 1970 now abandoned.

SUMMARY OF THE INVENTION

This invention relates in general to a method and material for use in shaft furnaces, and in particular to a new and useful method of making green hot briquettes from fine coal.

It was possible by the use of pelletized ores to achieve an increase in efficiency of blast furnace operation. This increase is based primarily on the fact that the uniform grain size of the charge increases its gas permeability and that both slag and pig iron can drain well under uniform furnace operation. Improved efficiency of operation has also been obtained by using briquetted coke which is given uniform particle size in its manufacture.

The briquetted coke can be produced in two-phase processes from fine coal with grain sizes below 3 mm. In the first phase, fine coal is carbonized, mixed with a percentage of coal with good caking ability and briquetted at temperatures between approximately 300° to 500° C. The hot briquettes thus produced are referred to herein as "green hot briquettes". A coal of a Sirelling index greater than 4 may be used as a coal of good caking ability in hot briquetting. Such a coal is designated as a "well caking coal" herein. The green hot briquettes are coked in the second phase of the process, the hot briquettes being coked, for example, together with sand in the temperature range of 900°-1000° C. in a throughput period of approximately 30 minutes. According to another method for the production of briquetted coke, noncaking coal is carbonized, briquetted under the addition of a binder and subsequently coked in furnaces. Such briquetted coke has also been used in blast furnaces on a trial basis, the share of briquetted coke amounting up to 30% of the total amount of coke in the furnace. Based on the tests, it was concluded that 30% of the entire amount of coke is replaceable by briquetted coke in blast furnaces of medium size, perhaps even more in smaller blast furnaces.

It is also known to use solid coal briquettes containing sufficient volatile ingredients to produce hydrogen for metal smelting in a vertical furnace. This method, in which coal developing much gas and having a high percentage (40%) content of volatile ingredients, is not suited for use in blast furnaces, however. The high gas percentages formed by these coal briquettes upon heating lead to an increase in pressure which complicates the operation of the furnace and practically makes the blast furnace operate as a hydrogen generator, which has an efficiency-reducing effect. Accordingly, this known method has only been applied to small test furnaces with a height of 2.3 m and an effective capacity of 0.33 $m^3$, the gas pressure in the lower part of the furnace rising to more than twice the pressure encountered when coke was used.

Starting from this state of the art, the invention provides a simple method for the use of solid fuels produced from fine coal in shaft furnaces, preferably blast furnaces and with trouble-free furnace operation, high yield and the least expense for fuel per ton of pig iron.

According to the invention, this is done by the use of green hot briquettes, produced from fine coal by carbonization at approximately 600° to 900° C., and mixing with approximately 10 to 80%, preferably 20 to 40%, fine, cold, well-caking coal, and hot briquetting at temperatures between approximately 300° and 500° C., as fuel in shaft furnaces, preferably blast furnaces.

Surprisingly, the green hot briquettes display good abrasion resistance and good strength which will not decrease by softening even when the temperature in, say, a blast furnace increases, which would lead to the destruction of the hot briquettes due to the increasing pressure of the charge column above the reducing charge. It rather seems to be so that the green hot briquettes coke without going through a softening interval while further increasing their strength as they reduce, together with the rest of the blast furnace charge in the furnace itself, their required strength never falling below specification at any time.

By saving the second phase of the method for producing solid fuels from fine coal, namely the cooling of the green hot briquettes, the processing costs for the solid fuels are lowered noticeably. The greater gas content of the green hot briquettes has proven advantageous, particularly in the applicant's tests in blast furnaces, in that the greater hydrogen content contributes to the reduction and increases the caloric value of the flue gas as compared to the conventional method using normal coke, thus obviating the known requirement for the addition of rich gas to the flue gas to heat the copers adequately.

On the other hand, so much volatile material is driven out of the fine coal in its carbonization between approximately 600° and 900° C. in the manufacture of the green briquettes that there is no production of an excess of hydrogen and other volatile materials in the furnace which will interfere with the furnace operation by increasing the pressure. On the contrary, in spite of their greater gas content compared to coke, the use of the green hot briquettes in place of briquetted coke even leads to a decrease of air pressure in the blast furnace. While the gas permeability of a briquetted coke charge is already noticeably greater than that of a normal lump coke charge, with a known beneficial effect on the furnace operation, the greater bulk weight of the hot briquettes compared to briquetted coke leads to a further increase in gas permeability when the pressure drop on the coke mass is related to the volumetric unit. The use of the green hot briquettes has not produced any difficulties by generating harmful ingredients which might interfere with gas purification.

Accordingly, it is an object of the invention to provide a method of making green hot briquettes from fine coal.

A further object of the invention is to provide a hot briquette for use in a shaft furnace as the only solid fuel.

A further object of the invention is to provide a method of making a green hot briquette from fine coal comprising carbonizing the coal at a temperature of from around 600° to 900° C., mixing the carbonized coal to approximately 10 to 80% of fine, cold, well caking coal, and hot briquetting the mixture at temperatures of from between around 300° to 500° C.

GENERAL DESCRIPTION OF THE PREFERRED EMBODIMENT

In detail, an advantageous implementation of the invention may be as follows:

The green hot briquettes may not only be used as an additive of approximately 30%, like the briquetted coke, in known methods, much rather optimum operating values are obtained when the green hot briquettes are used as the only solid fuel in the shaft furnace, preferably a blast furnace. This was proven by the applicant's tests, not only in small test furnaces, but also in a big blast furnace of 6.8 m hearth diameter and 25 m shaft height.

The advantages of using the green hot briquettes exist also for other shaft furnaces, such as cupelling furnaces, low shaft furnaces or lime shaft furnaces.

Operating results of a blast furnace when charged solely with green hot briquettes are given below as example:

In a cold condition, the green hot briquettes have a tensile strength of 200 kp/piece, the abrasion N 10 amounted to 7 - 8%. The volatile ingredients and the ash content amounted to approximately 7% each and the carbon content to 91 - 93%.

The composition of the volatile ingredients was $O_2$ = 0.0%
$N_2$ = 4.5%
$CO_2$ = 1.4%
CO = 6.7%
$H_2$ = 62.1%
$CNH_4$ = 23.1%
$C_nH_m$ = 1.6%
$H_2S$ = 0.1%

The chemical analysis of the briquettes was, in the average,

Carbon — 85.2%
Ash — 7.02%
Sulphur — 0.85%
Nitrogen — 1.15%
Hydrogen — 2.3%
Volatile ingredients — 7.1%
Ingredients extracted by benzol, less than 0.1%
The caloric value was 7300 kcal/kg There occurred no furnace troubles which were attributable to the use of the green hot briquettes. When changing from a charge of normal coke to one of green hot briquettes, the hydrogen content in the waste gas rose by approximately 2% and the caloric value of roughly 940 to 1020 kcal/$Nm^3$. There was no effects upon the pig iron temperature. The flue dust yield was at normal levels. The throughput resistance was reduced to 0.8 atm.abs., compared to the normal 1.2. Hot briquettes taken from the bed plane when the furnace was shut down still retained their original shape. This proves the good stability of the hot briquettes under operating conditions of the blast furnace over the entire height of the charge from the throat to the hearth.

Thus, the invention provides a method of manufacturing green hot briquettes from fine coal by carbonizing the coal at a temperature from around 600° to 900° C., thereafter mixing the carbonized coal with approximately 10 to 80% and preferably in the range of 20 to 40% of fine cold well caking coal, and thereafter hot briquetting the mixture at temperatures of from between around 300° to 500° C. The invention suggests the use of these hot briquettes as a solid fuel in shaft furnaces, preferably blast furnaces.

What is claimed is:

1. A method of operating blast furnaces, by using green hot briquettes produced from fine coal as fuel and wherein the green briquettes are formed by carbonizing the coal at a temperature of from about 600° to 900° C., mixing the carbonized coal with approximately 20 to 40% of fine, cold, well-caking coal, and hot-briquetting the mixture at temperatures between around 300° and 500° C. and directing the briquettes into the blast furnace without further processing thereof.

2. A method of operating a blast furnace, according to claim 1, wherein the green hot briquettes comprise the only solid fuel in the shaft furnace.

3. A method of operating a shaft furnace by using briquettes as fuel made by carbonizing fine coal of a grain size less than 3 mm at a temperature of from about 600° to 900° C., then mixing it with about 20 to 40% of fine well-caking coal, and thereafter briquetting this mixture at a temperature of about 300° to 500° C. and directly using this fuel in the blast furnace without coking it.

* * * * *